US005354649A

United States Patent [19]

Bell et al.

[11] Patent Number: 5,354,649

[45] Date of Patent: Oct. 11, 1994

[54] COLOR PHOTOGRAPHIC SILVER HALIDE MATERIAL

[75] Inventors: Peter Bell, Cologne; Jürgen Haekel, Leverkusen; Cuong Ly, Cologne; Reinhart Matejec, Leverkusen; Ralf Wichmann, Bergisch Gladbach, all of Fed. Rep. of Germany

[73] Assignee: Agfa Gevaert Aktiengesellschaft, Leverkusen, Fed. Rep. of Germany

[21] Appl. No.: 101,833

[22] Filed: Aug. 4, 1993

[30] Foreign Application Priority Data

Aug. 17, 1992 [DE] Fed. Rep. of Germany ..... 42207075

[51] Int. Cl.[5] ..... G03C 7/26

[52] U.S. Cl. ..... 430/543; 430/376; 430/383; 430/550

[58] Field of Search ..... 430/357, 376, 383, 384, 430/385, 386, 387, 388, 389, 391, 543, 552, 553, 554, 555, 556, 557, 558, 567, 963, 550

[56] References Cited

U.S. PATENT DOCUMENTS

| | | | |
|---|---|---|---|
| 4,952,490 | 8/1990 | Takada et al. | 430/567 |
| 4,952,491 | 8/1990 | Nishikawa et al. | 430/570 |
| 5,024,925 | 6/1991 | Deguchi | 430/385 |
| 5,202,224 | 4/1993 | Yamakawa et al. | 430/385 |

FOREIGN PATENT DOCUMENTS

0468780A1 1/1992 European Pat. Off. .

*Primary Examiner*—Hoa Van Le
*Attorney, Agent, or Firm*—Connolly and Hutz

[57] ABSTRACT

A color photographic silver halide material in which at least one silver halide emulsion consists of 85 to 99 mol-% AgCl, 1 to 10 mol-% AgI and 0 to 5 mol-% AgBr has high sensitivity (camera sensitivity) and can be developed in at most 120 s.

2 Claims, No Drawings

COLOR PHOTOGRAPHIC SILVER HALIDE MATERIAL

This invention relates to color photographic silver halide material which is suitable for rapid processing and which comprises on a support at least one red-sensitive, cyan-coupling silver halide emulsion layer, at least one green-sensitive, magenta-coupling silver halide emulsion layer and at least one blue-sensitive, yellow-coupling silver halide emulsion layer.

It is known that high-AgCl silver bromide chloride emulsions can be developed particularly quickly in low-bromide and low-iodide color developers (EP 366 954, 410 450, U.S. Pat. Nos. 4,952,491, 4,952,490). However, they are relatively non-sensitive compared to high-AgBr silver halide emulsions. In addition, they cannot be adequately inhibited by DIR compounds (development inhibitor releasing compounds) so that very poor edge and inter-image effects are obtained.

If the bromide content of high-AgCl silver bromide chloride emulsions is increased (see EP 468 780), sensitivity and inhibitability are significantly increased. However, rapid processing (development time below 120 seconds at 30° to 40° C.) is only possible if the developer is regenerated, i.e. freshened, to a far greater extent than is usual at the present time because the bromide ions passing over from the material into the developer decelerate development and have to be removed as quickly as possible from the developer bath.

This decelerating effect is even greater in the development of silver bromide iodide emulsions. Short-time processing is virtually impossible in this case.

The problem addressed by the present invention was to develop silver halide emulsions which would not only provide a photographic material with high sensitivity, but would also make it developable to standard color densities by rapid processing (see above).

Such photographic properties as fog, grain and sharpness should not be adversely affected and should at least correspond to the usual standard. The material should also be storable in unexposed and exposed form.

It has now surprisingly been found that these problems can be solved by silver halide emulsions which have a high AgCl content, a considerable AgI content and, at most, a small AgBr content.

Accordingly, the present invention relates to a color photographic silver halide material of the type mentioned at the beginning, in which the silver halide emulsion of at least one photosensitive silver halide emulsion layer consists of 85 to 99 mol-% AgCl, 1 to 10 mol-% AgI and 0 to 5 mol-% AgBr. The silver halide emulsion preferably consists of 93 to 98 mol-% AgCl, 2 to 5 mol-% AgI and 0 to 2 mol-% AgBr.

In one preferred embodiment, the color photographic material additionally contains a layer which is arranged further from the support than each photosensitive layer and which contains a silver halide with at least 98 mol-% AgCl which is non-sensitive in the visible spectral region.

The silver halide emulsion to be used in accordance with the invention for the at least one photosensitive silver halide emulsion layer may be, in particular, a core-shell emulsion, i.e. an emulsion of which the grains have a layered structure, the iodide content being greater in the core than in the shell, or a platy emulsion, i.e. an emulsion which at least 50% of the grains have a platy habit, the diameter-to-thickness ratio of the plates being at least 3. The diameter of the grains is taken to be the diameter of a circle equal in area to the projected area.

The color photographic material according to the invention is, in particular, a material with camera sensitivity and contains a total silver halide coating of photosensitive silver halide, expressed as equivalent $AgNO_3$, of 3 to 14 g/m$^2$ and, more particularly, 3 to 8 g/m$^2$.

All the photosensitive silver halide emulsion layers preferably contain AgClI emulsions of the type mentioned.

Examples of color photographic materials are color negative films, color reversal films, color positive films, color photographic paper, color reversal photographic paper, dye-sensitive materials for the dye diffusion transfer process or the silver dye bleaching process.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or α-olefin polymer layer (for example polyethylene). These supports may be dyed with dyes and pigments, for example titanium dioxide. The surface of the support is generally subjected to a treatment to improve the adhesion of the photographic emulsion layer, for example to a corona discharge with subsequent application of a substrate layer.

The color photographic materials contain the usual interlayers and protective layers in addition to the red-sensitive, green-sensitive and blue-sensitive silver halide emulsion layers already mentioned.

In addition to the silver halide grains, binders and color couplers are essential constituents of the photographic emulsion layers.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose, and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. Oxidized gelatine may also be used. The production of such gelatines is described, for example, in The Science and Technology of Gelatine, edited by A.G. Ward and A. Courts, Academic Press 1977, pages 295 et seq. The particular gelatine used should contain as few photographically active impurities as possible (inert gelatine). Gelatines of high viscosity and low swelling are particularly advantageous.

The average grain size of the emulsions is preferably between 0.2 μm and 2.0 μm; the grain size distribution may be both homodisperse and heterodisperse. A homodisperse grain size distribution means that 95% of the grains differ from the average grain size by no more than ±30%. In addition to the silver halide, the emulsions may also contain organic silver salts, for example silver benztriazolate or silver behenate.

Two or more types of silver halide emulsions prepared separately may also be used in the form of a mixture. Thus, mixtures of several homodisperse emulsions differing in their grain size may also be used, for example to adjust desired gradations.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V.L. Selikman et al, Making and Coating Photographic Emulsion, The Focal Press, London (1966)).

Precipitation of the silver halide is preferably carried out in the presence of the binder, for example gelatine, in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which new nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

Salts or complexes of metals, such as Cd, Zn, Pb, Tl, Bi, Ir, Rh, Fe, may also be present during the precipitation and/or physical ripening of the silver halide grains.

In addition, precipitation may even be carried out in the presence of sensitizing dyes. Complexing agents and/or dyes may be inactivated at any time, for example by changing the pH value or by an oxidative treatment.

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and sensitizer concentration) until sensitivity and fogging are both optimal. The process is described, for example, in H. Frieser "Die Grundlagen der Photographischen Prozesse mit Silberhalogeniden", pages 675–734, Akademische Verlagsgesellschaft (1968).

Chemical sensitization may be carried out with addition of compounds of sulfur, selenium, tellurium and/or compounds of metals of the VIIIth secondary group of the periodic system (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964, and in Ullmanns Encyclopädie der technischen Chemie, 4th Edition, Vol. 18, pages 431 et seq and Research Disclosure No. 17643 (December 1978), Chapter III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsions may contain compounds to prevent fogging or to stabilize the photographic function during production, storage and photographic processing.

Particularly suitable compounds of this type are azaindenes, preferably tetra- and pentaazindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, optionally substituted benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure No. 17643 (December 1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfur or phosphoric acid esters of an aminoalcohol.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found, for example, in Research Disclosure 17643 (December 1978), Chapter IV.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathia or selenocarbocyanines and 9-ethyl naphthothiaoxa- and benzimidazocarbocyanines, providing the dyes contain at least one sulfoalkyl group at the heterocyclic nitrogen;

2. as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;

3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

Non-diffusing monomeric or polymeric color couplers are associated with the differently sensitized emulsion layers and may be arranged in the same layer or in an adjacent layer. The spectral association was mentioned at the beginning.

Color couplers for producing the cyan dye image are generally couplers of the phenol or α-naphthol type, for example α-ureidophenols and 1,5-aminonaphthols.

Color couplers for producing the magenta dye image are generally couplers of the 5-pyrazolone, indazolone or pyrazoloazole type.

Color couplers for producing the yellow dye image are generally couplers bearing an open-chain ketomethylene group, more particularly couplers of the α-acylacetamide type, of which suitable examples are α-benzoylacetanilide couplers and α-pivaloylacetanilide couplers.

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers) and white couplers which give substantially colorless products on reaction with color developer oxidation products. The material according to the invention preferably contains cyan-coupling red mask couplers, cyan-coupling yellow mask couplers and/or magenta-coupling yellow mask couplers. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE-A-33 19 428). Examples of 2-equivalent couplers such as these are the known DIR couplers and also DAR and FAR couplers.

DIR couplers containing development inhibitors of the azole type, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages in regard to color reproduction, i.e. color separation and color purity, and in regard to detail reproduction, i.e. sharpness and graininess, can be obtained with DIR couplers which, for example, do not release the development inhibitor as the direct result of coupling with an oxidized color developer, but only after a further reaction, for example with a timing group. Examples of DIR couplers such as these can be found in DE-A-28 55 697, 32 99 671, 38 18 231, 35 18 797, in EP-A-0 157 146 and 0 204 175, in U.S. Pat. Nos.4,146,396 and 4,438,393 and in GB-A-2,072,363.

DIR couplers releasing a development inhibitor which is decomposed in the developer bath to photographically substantially inactive products are described, for example, in DE-A-3 209 486 and in EP-A-0 167 168 and 0 219 713. Problem-free development and stable processing are achieved by this measure.

Where DIR couplers, particularly those releasing a readily diffusible development inhibitor, are used, improvements in color reproduction, for example a more differentiated color reproduction, can be obtained by suitable measures during optical sensitization, as described for example in EP-A-0 115 304, 0 167 173, GB-A-2,165,058, DE-A-37 00 419 and U.S. Pat. No. 4,707,436.

In a multilayer photographic material, the DIR couplers may be added to various layers, including for example even non-photosensitive layers or interlayers. However, they are preferably added to the photosensitive silver halide emulsion layers, the characteristic properties of the silver halide emulsion, for example its iodide content, the structure of the silver halide grains or their grain size distribution, influencing the photographic properties obtained. The effect of the inhibitors released may be limited, for example by the incorporation of an inhibitor-trapping layer according to DE-A-24 31 223. For reasons of reactivity or stability, it may be of advantage to use a DIR coupler which, in the particular layer into which it is introduced, forms a color differing from the color to be produced in that layer during the coupling reaction.

To increase sensitivity, contrast and maximum density, it is possible to use above all DAR or FAR couplers which release a development accelerator or a fogging agent. Compounds of this type are described, for example, in DE-A-25 34 466, 32 09 110, 33 33 355, 34 10 616, 34 29 545, 34 41 823, in EP-A-0 089 834, 0 110 511, 0 118 087, 0 147 765 and in U.S. Pat. Nos.4,618,572 and 4,656,123.

An example of the use of BAR (bleach accelerator releasing) couplers can be found in EP-A-0 193 389.

It can be of advantage to modify the effect of a photographically active group released from the coupler by an intermolecular reaction between this group after its release and another group in accordance with DE-A-35 06 805.

Since, in the case of DIR, DAR and FAR couplers, the activity of the group released during the coupling reaction is largely desirable with less importance being attributed to the dye-producing properties of these couplers, DIR, DAR and FAR couplers which give substantially colorless products during the coupling reaction are also suitable (DE-A-15 47 640).

The releasable group may also be a ballast group, so that coupling products which are diffusible or which at least show slight or limited mobility are obtained in the reaction with color developer oxidation products (U.S. Pat. No. 4,420,556).

The material may also contain compounds different from couplers which may release, for example, a development inhibitor, a development accelerator, a bleaching accelerator, a developer, a silver halide solvent, a fogging agent or an anti-fogging agent, for example so-called DIR hydroquinones and other compounds of the type described, for example, in U.S. Pat. Nos.4,636,546, 4,345,024, 4,684,604 and in DE-A-31 45 640, 25 15 213, 24 47 079 and in EP-A-198 438. These compounds perform the same function as the DIR, DAR or FAR couplers except that they do not form coupling products.

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. Nos. 2,322,027, 2,801,170, 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-t-amyl phenol, dioctyl acetate, glycerol tributyrate, isostearyl lactate, trioctyl citrate, N,N-dibutyl-2-butoxy-5-t-octyl aniline, paraffin, dodecylbenzene and diisopropyl naphthalene.

Each of the differently sensitized photosensitive layers may consist of a single layer or may even comprise two or more partial silver halide emulsion layers (DE-C-1 121 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

Alternating layer arrangements as described, for example, in DE 25 30 645 may also be used.

Providing the blue sensitivity of the green-sensitive or red-sensitive layers is suitably low, it is possible to select other layer arrangements without the yellow filter layer, in which for example the blue-sensitive layers, then the red-sensitive layers and finally the green-sensitive layers follow one another on the support.

The non-photosensitive interlayers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers or DOP trappers, are described in Research Disclosure 17 643 (December 1978), Chapters VII, 17 842 (February 1979) and 18 716 (November 1979), page 650 and in EP-A-0 069 070, 0 098 072, 0 124 877, 0 125 522.

Examples of particularly suitable compounds are 2,5-dialkyl-substituted hydroquinones.

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect the image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos.3,705,805 and 3,707,375), butadiene compounds (U.S. Pat. No. 4,045,229) or benzoxazole compounds (U.S. Pat. No. 3,700,455).

It is also possible to use UV-absorbing couplers (such as cyan couplers of the α-naphthol type) and UV-absorbing polymers. These UV absorbers may be fixed in a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, in U.S. Pat. Nos. 2,632,701 and 3,269,840 and in GB-A-852,075 and 1,319,763.

Certain binder layers, particularly the layer furthest from the support, but occasionally interlayers as well, particularly where they are the layer furthest from the support during production, may contain inorganic or organic, photographically inert particles, for example as matting agents or as spacers (DE-A-33 31 542, DE-A-34 24 893, Research Disclosure 17 643 (December 1978), Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Additives for improving dye, coupler and white stability and for reducing color fogging (Research Disclosure 17 643 (December 1978), Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) are particularly effective for preventing the impairment of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment of magenta-red dye images, particularly their impairment as a result of the effect of light.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea),2-hydroxy-4,6-dichloro-1,3,5-triazine and other compounds containing reactive halogen (U.S. Pat. Nos. 3,288,775, 2,732,303, GB-A-974,723 and GB-A-1,167,207), divinylsulfone compounds, 5-acetyl-1,3-diacryloyl hexahydro-1,3,5-triazine and other compounds containing a reactive olefin bond (U.S. Pat. Nos. 3,635,718, 3,232,763 and GB-A-994,869); N-hydroxymethyl phthalimide and other N-methylol compounds (U.S. Pat. Nos. 2,732,316 and 2,586,168); isocyanates (U.S. Pat. No. 3,103,437); aziridine compounds (U.S. Pat. Nos. 3,017,280 and 2,983,611); acid derivatives (U.S. Pat. Nos. 2,725,294 and 2,725,295); compounds of the carbodiimide type (U.S. Pat. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468), 2-sulfonyloxy pyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole type (U.S. Pat. Nos. 3,321,313 and 3,543,292); halocarboxyaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

Suitable examples of instant hardeners are compounds corresponding to the following general formulae:

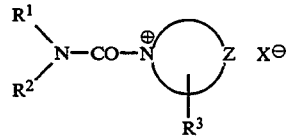

(a)

in which $R^1$ is alkyl, aryl or aralkyl, $R^2$ has the same meaning as $R^1$ or represents alkylene, arylene, aralkylene or alkaralkylene, the second bond being attached to a group corresponding to formula

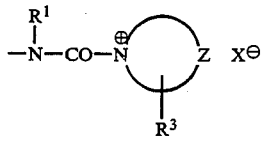

or $R^1$ and $R^2$ together represent the atoms required to complete an optionally substituted heterocyclic ring, for example a piperidine, piperazine or morpholine ring, the ring optionally being substituted, for example, by $C_{1-3}$ alkyl or halogen, $R^3$ is hydrogen, alkyl, aryl, alkoxy, $—NR^4—COR^5$, $—(CH_2)_m—NR^8R^9$, $—(CH_2)_n—CONR^{13}R^{14}$ or $$—(CH_2)_p—\underset{\underset{R^{15}}{|}}{CH}—Y—R^{16}$$

or is a bridge member or a direct bond to a polymer chain, $R^4$,$R^6$, $R^7$, $R^9$, $R^{14}$, $R^{15}$, $R^{17}$, $R^{18}$ and $R^{19}$ being hydrogen or $C_{1-4}$ alkyl, $R^5$ being hydrogen, $C_{1-4}$ alkyl or $NR^6R^7$, $R^8$ being $—COR^{10}$, $R^{10}$ being $NR^{11}R^{12}$, $R^{11}$ being $C_{1-4}$ alkyl or aryl, particularly phenyl, $R^{12}$ being hydrogen, $C_{1-4}$ alkyl or aryl, particularly phenyl, $R^{13}$being hydrogen, $C_{1-4}$ alkyl or aryl, particularly phenyl, $R^{16}$being hydrogen, $C_{1-4}$ alkyl, $COR^{18}$ or $CONHR^{19}$, m being a number of 1 to 3, n being a number of 0 to 3, p being a number of 2 to 3 and y being O or $NR^{17}$ or $R^{13}$ and $R^{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6-membered aromatic heterocyclic ring, optionally with a fused benzene ring, and $X^{\ominus}$ is an anion which is unnecessary where an anionic group is already attached to the rest of the molecule;

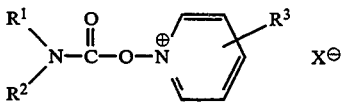

(b)

in which $R^1$, $R^2$, $R^3$ and $X^{\ominus}$ are as defined for formula (a).

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A 0 114 699).

Color photographic negative materials are normally processed by development, bleaching, fixing and washing or by development, bleaching, fixing and stabilization without subsequent washing; bleaching and fixing may be combined into a single process step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine,1-(N-ethyl-N-methanesulfonamidoethyl)-3-methyl-p-phenylenediamine, 1-(N-ethyl-N-hydroxyethyl)-3-methyl-p-phenylenediamine, 1-(N-ethyl-N-hydroxypropyl)-3-methyl-p-phenylenediamine and 1-(N-ethyl-N-methoxyethyl)-3-methyl-p-phenylenediamine. Other useful color developers are described, for example, in J. Amer. Chem. Soc. 73, 3106 (1951) and in G. Haist, Modern Photographic Processing, 1979, John Wiley and Sons, New York, pages 545 et seq.

Color development may be followed by an acidic stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraacetic acid, diethylenetriamine pentaacetic acid, nitrilotriacetic acid, iminodiacetic acid, N-hydroxyethyl ethylene diamine triacetic acid, alkyliminodicarboxylic acids, and of corresponding phosphonic acids. Other suitable bleaches are persulfates and peroxides, for example hydrogen peroxide. Ethylenediamine tetraacetic acid, propylenediamine tetraacetic acid or, in particular, nitrilodiacetic monopropionic acid is preferably used as the complexing agent. Mixtures of the complexing agents mentioned may also be used.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

Color reversal materials are first subjected to development with a black-and-white developer of which the oxidation product is not capable of reacting with the color couplers. Development is followed by a diffuse second exposure and then by development with a color developer, bleaching and fixing.

The materials according to the invention are preferably processed in a short-time process in which the development time is no more than 120 seconds and preferably no more than 60 seconds.

The color developer preferably contains no more than $7 \cdot 10^{-4}$ mol bromide/l and no more than $7 \cdot 10^{-5}$ mol iodide/l. Preferred color developer substances correspond to the formula:

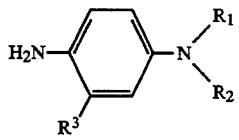

in which $R_1$ is hydroxy-$C_{2-4}$-alkyl and $R_2$ and $R_3$ represents $C_{1-4}$ alkyl or at least one substituent $R_1$, $R_2$ and $R_3$ is $\beta$-methanesulfonamidoethyl and the other two are optionally hydroxy- or sulfo- substituted $C_{1-4}$ alkyl.

The color developer is adjusted in particular to a pH value of 9 to 12 and to a temperature of 30° to 50° C. and may contain typical antioxidants, complexing agents, substances for preventing crystallization of the developer substance and the like.

The regeneration quota of the developer for the material according to the invention is preferably at most 800 ml/m² and, more particularly, at most 600 ml/m², the composition of the regenerator being such that the required minimum quantities of necessary substances in the developer bath are maintained by the above-mentioned regeneration quota.

Since 50 to 150 ml developer/m² are normally carried over into the next bath with the material by processing, an overflow is established in accordance with the following formula:

*regeneration quota—carryover=overflow*

The overflow is preferably rejuvenated and returned to the process, normally to the regenerator.

Processing is preferably carried out continuously, the processing baths being continuously regenerated and the bath overflows continuously rejuvenated.

It is of particular advantage for the bleaching and fixing bath to be substantially free from ammonium ions.

Washing after fixing and, optionally, washing before fixing is carried out in particular with less than 60 l/m² and preferably less than 40 l/m².

PREPARATION OF THE SILVER HALIDE EMULSIONS

Emulsion 1: Comparison emulsion (0.4 μm grain diameter, $AgCl_{0.7}Br_{0.3}$ with homogeneous halide distribution)

1,500 ml of a 1.35 molar $AgNO_3$ solution (solution 1) and 1,500 ml of a 1.35 molar halide solution (solution 2: 70 mol-% NaCl and 30 mol-% KBr) were each added with stirring at 55° C./pH 4.4 to 9 l of an aqueous solution containing 350 g gelatine, 50 g NaCl and 60 g methionine at a rate of 600 ml/min. by the dual inflow process. After heating for 20 minutes at 55° C., 8,000 ml of a 3-molar $AgNO_3$ solution (solution 3) and 8,000 ml of a 3-molar halide solution (solution 4: 70 mol-% NaCl and 30 mol-% KBr) were added at increasing rates over a period of 45 minutes by the dual inflow process so that the final inflow rates of the solutions were 4 times higher than the initial inflow rates. The emulsion was flocculated, washed, redispersed with a solution of 1,630 g gelatine in 8 l water and adjusted to pH 6.0/pAg 8.

The emulsion was ripened to maximum sensitivity at 60° C. with 11.25 μmol sodium thiosulfate, 11.25 μmol tetrachlorohydroauric acid and 1,125 μmol potassium thiocyanate/mol Ag.

The emulsion was homodisperse and was homogeneously made up of 70 mol-% AgCl and 30 mol-% AgBr. The silver halide crystals were cubic in shape. The most common crystal diameter was 0.4 μm, 90% of the crystals having a diameter of >0.37 μm and <0.42 μm.

Emulsion 2: Comparison emulsion (0.8 μm grain diameter, $AgCl_{0.7}Br_{0.3}$ with uniform halide distribution)

The precipitation of this emulsion corresponded to the precipitation of emulsion 1 except that solutions 1 and 2 were only added at an inflow rate of 80 ml/min.

The emulsion was ripened to maximum sensitivity at 55° C. with 5 μmol sodium thiosulfate, 5 μmol tetrachlorohydroauric acid and 500 μmol potassium thiocyanate/mol Ag.

The emulsion was homodisperse and was homogeneously made up of 70 mol-% AgCl and 30 mol-% AgBr. The silver halide crystals were cubic in shape. The most common crystal diameter was 0.81 μm, 90% of the crystals having a diameter of >0.77 μm and <0.84 μm.

Emulsion 3: Comparison emulsion (0.4 μm graim diameter, AgCl)

The precipitation of this emulsion corresponded to the precipitation of emulsion 1 except that solutions 2 and 4 were replaced by pure NaCl solutions (solution 5: 1.35-molar AgCl solution; solution 6: 3-molar AgCl solution) and precipitation was carried out at 45° C.

The emulsion was ripened to maximum sensitivity at 45° C. with 5.6 μmol sodium thiosulfate, 5.6 μmol tetrachlorohydroauric acid and 560 μmol potassium thiocyanate/mol Ag.

The silver halide crystals were homodisperse and cubic in shape. The most common crystal diameter was 0.41 μm, 90% of the crystals having a diameter of >0.39 μm and <0.42 μm.

Emulsion 4: Comparison emulsion (0.8 μm grain diameter, AgCl)

The precipitation of this emulsion corresponded to the precipitation of emulsion 3 except that solutions 1 and 5 were only added at an inflow rate of 80 ml/min.

The emulsion was ripened to maximum sensitivity in the same way as emulsion 3.

The silver halide crystals were cubic in shape. The most common crystal diameter was 0.82 μm, 90% of the crystals having a diameter of >0.75 μm and <0.87 μm.

Emulsion 5: Invention emulsion (0.4 μm grain diameter, $AgCl_{0.96}I_{0.04}$ with uniform halide distribution)

1,500 ml of a 1.35 molar $AgNO_3$ solution (solution 1) and 1,500 ml of a 1.35 molar halide solution (solution 7: 96 mol-% NaCl and 4 mol-% KI) were each added with stirring at 60° C./pH 4.4 to 9 l of an aqueous solution containing 700 g gelatine, 100 g NaCl and 60 g methionine at a rate of 270 ml/min. by the dual inflow process. After heating for 10 minutes at 60° C., 8 l of a 3-molar $AgNO_3$ solution (solution 3) and 8 l of a 3-molar halide solution (solution 8: 96 mol-% NaCl and 4 mol-% KI) were added at increasing rates over a period of 75 minutes by the dual inflow process so that the final inflow rates of the solutions were 3 times higher than the initial inflow rates. The emulsion was flocculated, washed, redispersed with a solution of 1,280 g gelatine in 8 l water and adjusted to pH 4.5/pAg 8.

The emulsion was ripened to maximum sensitivity at 55° C. with 3.2 μmol sodium thiosulfate, 0.5 μmol tetrachlorohydroauric acid and 50 μmol potassium thiocyanate/mol Ag.

The emulsion was homodisperse and was homogeneously made up of 96 mol-% AgCl and 4 mol-% AgI. The silver halide crystals were cubic in shape. The most common crystal diameter was 0.41 μm, 90% of the crystals having a diameter of>0.39 μm and<0.44 μm.

Emulsion 6: Invention emulsion (0.8 μm grain diameter, $AgCl_{0.96}I_{0.04}$ with uniform halide distribution)

The precipitation of emulsion 6 corresponded to the precipitation of emulsion 5 except that solutions 1 and 7 were only added at an inflow rate of 35 ml/min.

The emulsion was ripened to maximum sensitivity at 50° C. with 1.5 μmol sodium thiosulfate, 0.2 μmol tetrachlorohydroauric acid and 20 μmol potassium thiocyanate/mol Ag.

The silver halide crystals were cubic in shape. The most common crystal diameter was 0.83 μm, 90% of the crystals having a diameter of>0.76 μm and<0.87 μm.

Emulsion 7: Invention emulsion (0.4 μm grain diameter, $AgCl_{0.95}Br_{0.01}I_{0.04}$ with uniform AgClI distribution in the core and AgBr in the shell)

The precipitation of this emulsion corresponded to the precipitation of emulsion 5, except that 260 ml of a 1-molar $AgNO_3$ solution and 260 ml of a 1-molar KBr solution were each added at an inflow rate of 26 ml/min. at the end of the second dual inflow.

Flocculation, washing, redispersion and ripening were carried out in the same way as for emulsion 5.

The emulsion was homodisperse and was made up of two zones, namely:

Zone 1 (core) of $AgCl_{0.96}I_{0.04}$ (99 mol-%)

Zone 2 (shell) of AgBr (1 mol-%).

The silver halide crystals were cubic in shape. The most common crystal diameter was 0.42 μm, 90% of the crystals having a diameter of>0.40 μm and<0.44 μm.

Emulsion 8: Invention emulsion (0.8 μm grain diameter, $AgCl_{0.95}Br_{0.01}I_{0.04}$ with uniform AgClI distribution in the core and AgBr in the shell)

The precipitation of this emulsion corresponded to the precipitation of emulsion 6, except that 260 ml of a 1-molar $AgNO_3$ solution and 260 ml of a 1-molar KBr solution were leach added at an inflow rate of 26 ml/min. at the end of the second dual inflow.

Flocculation, washing, redispersion and ripening were carried out in the same way as for emulsion 6.

The emulsion was homodisperse and was made up of two zones, namely:

Zone 1 (core) of $AgCl_{0.96}I_{0.04}$ (99 mol-%)

Zone 2 (shell) of AgBr (1 mol-%).

The silver halide crystals were cubic in shape. The most common crystal diameter was 0.83 μm, 90% of the crystals having a diameter of>0.78 μm and<0.88 μm.

Emulsion 9: Invention emulsion (0.4 μm grain diameter, $AgCl_{0.96}I_{0.04}$, core: $AgCl_{0.94}I_{0.06}$ shell: $AgCl_{0.98}I_{0.02}$)

9,600 ml of a molar $AgNO_3$ solution (solution 1) and 9,600 ml of a 1.35 molar halide solution (solution 9: 94 mol-% NaCl and 6 mol-% KI) were each added with stirring at 70° C./pH 4.4 to 9 l of an aqueous solution containing 700 g gelatine, 100 g NaCl and 60 g methionine at a rate of 200 ml/min. by the dual inflow process. After heating for 30 minutes at 70° C., 4,330 ml of a 3-molar $AgNO_3$ solution (solution 3) and 4,330 ml of a 3-molar halide solution (solution 10:98 mol-% NaCl and 2 mol-% KI) were added at increasing rates over a period of 24 minutes by the dual inflow process so that the final inflow rates of the solutions were 3 times higher than the initial inflow rates. The emulsion was flocculated, washed, redispersed and ripened to maximum sensitivity in the same way as emulsion 5.

The emulsion was made up of two zones, namely:

Zone 1 (core) of $AgCl_{0.94}I_{0.06}$ (50 mol-%)

Zone 2 (shell) of $AgCl_{0.98}I_{0.02}$ (50 mol-%).

The silver halide crystals were cubic in shape. The most common crystal diameter was 0.39 μm, 85% of the crystals having a diameter of>0.35 μm and<0.42 μm.

Emulsion 10: Invention emulsion (0.4 μm grain diameter, $AgCl_{0.96}I_{0.04}$, core: $AgCl_{0.94}I_{0.06}$ shell: $AgCl_{0.98}I_{0.02}$)

The precipitation of this emulsion corresponded to the precipitation of emulsion 9 except solutions 1 and 9 were each added at an inflow rate of 25 ml/min.

Flocculation, washing, redispersion and ripening were carried out in the same way as for emulsion 6.

The emulsion was made up of two zones, namely:

Zone 1 (core) of $AgCl_{0.94}I_{0.06}$ (50 mol-%)

Zone 2 (shell) of $AgCl_{0.98}I_{0.02}$ (50 mol-%).

The silver halide crystals were cubic in shape. The most common crystal diameter was 0.78 μm, 85% of the crystals having a diameter of>0.75 μm and<0.87 μm.

Emulsion 11: Invention emulsion (0.4 μm grain diameter, $AgCl_{0.95}I_{0.04}Br_{0.01}$, core: $AgCl_{0.94}I_{0.06}$ 1st shell: $AgCl_{0.98}I_{0.02}$ 2 nd shell: AgBr)

The precipitation of this emulsion corresponded to the precipitation of emulsion 9, except that 130 ml of a 1-molar $AgNO_3$ solution and 130 ml of a 1-molar KBr solution were each added at an inflow rate of 26 ml/min. at the end of precipitation.

Flocculation, washing, redispersion and ripening were carried out in the same way as for emulsion 9.

The emulsion was made up of three zones, namely:

Zone 1 (core) of $AgCl_{0.94}I_{0.06}$ (49.75 mol-%)

Zone 2 (1st shell) of $AgCl_{0.98}I_{0.02}$ (49.75 mol-%)

Zone 3 (2nd shell) of AgBr (0.5 mol-%)

The silver halide crystals were cubic in shape. The most common crystal diameter was 0.40 μm, 85% of the crystals having a diameter of>0.36 μm and<0.44 μm.

Emulsion 12: Invention emulsion (0.8 μm grain diameter, $AgCl_{0.955}I_{0.04}Br_{0.005}$, core: $AgCl_{0.94}I_{0.06}$ 1st shell: $AgCl_{0.98}I_{0.02}$ 2nd shell: AgBr)

The precipitation of this emulsion corresponded to the precipitation of emulsion 10, except that 130 ml of a 1-molar $AgNO_3$ solution and 130 ml of a 1-molar KBr solution were each added at an inflow rate of 26 ml/min. at the end of precipitation.

Flocculation, washing, redispersion and ripening were carried out in the same way as for emulsion 10.

The emulsion was made up of three zones, namely:
Zone 1 (core) of $AgCl_{0.94}I_{0.06}$ (49.75 mol-%)
Zone 2 (1st shell) of $AgCl_{0.98}I_{0.02}$ (49.75 mol-%)
Zone 3 (2nd shell) of AgBr (0.5 mol-%)

The silver halide crystals were cubic in shape. The most common crystal diameter was 0.78 μm, 85% of the crystals having a diameter of>0.74 μm and<0.88 μm.

Emulsion 13: Invention emulsion (0.8 μm grain diameter, $AgCl_{0.98}I_{0.02}$, with uniform halide distribution).

The precipitation of emulsion 13 corresponded to the precipitation of emulsion 6 except that solutions 7 and 8 were replaced by 1.35-molar and 3-molar solutions of 98 mol-% NaCl and 2 mol-% KI.

The silver halide crystals were cubic in shape. The most common crystal diameter was 0.81 μm, 95% of the crystals having a diameter of>0.78 μm and<0.84 μm.

Emulsion 14: Invention emulsion (0.8 μm grain diameter, $AgCl_{0.93}I_{0.07}$, with uniform halide distribution).

The precipitation of emulsion 14 corresponded to the precipitation of emulsion 6 except that solutions 7 and 8 were replaced by 1.35-molar and 3-molar solutions of 93 mol-% NaCl and 7 mol-% KI.

The silver halide crystals were cubic in shape. The most common crystal diameter was 0.83 μm, 80% of the crystals having a diameter of>0.77 μm and<0.85 μm.

EXAMPLES

The following layers were applied in the order listed to a transparent layer support of cellulose triacetate. The quantities are all based on 1 $m^2$. For the silver halide coating, the equivalent quantities of $AgNO_3$ are shown. All the silver halide emulsions were stabilized with 0.05 g 1-phenyl-5-mercaptotetrazole per 100 g $AgNO_3$.

EXAMPLE 1

1st layer (green-sensitized layer)
2.50 g $AgNO_3$ of a green-sensitized emulsion according to Table 1
3.00 g gelatine
0.63 g magenta coupler M1
0.63 g tricresyl phosphate (TCP)
2nd layer (protective and hardening layer)
0.68 g gelatine
0.63 g hardener H1

Layer combinations 1G to 1M corresponded to layer combinations 1A to 1F, the first layer addition containing 0.026 g DIR coupler DIR1.

After exposure of a grey wedge onto the materials thus prepared, they were processed as follows:

| Processing bath | Time [s] | Temperature [°C.] | Regeneration quota [l/m² film] |
|---|---|---|---|
| Developer | 45 | 38 | 0.50 |
| Bleaching bath | 45 | 38 | 0.13 |
| Washing | 45 | 38 | 2 |
| Fixing bath | 45 | 38 | 0.50 |
| Washing | 90 | 38 | 2 (3 × cascade) |
| Final bath | 45 | 38 | 0.50 |

The individual processing baths had the following composition:

| Developer: | |
|---|---|
| Water | 0.9 l |
| Ethylenediamine tetraacetic acid (EDTA) | 2 g |
| Hydroxyethane diphosphonic acid (HEDP) 60% by weight aqueous solution | 0.5 ml |
| Sodium chloride | 2 g |
| N,N-diethyl hydroxylamine, 85% by weight aqueous solution | 5 ml |
| 4-(N-ethyl-N-2-methanesulfonylamino-ethyl)-2-methylphenylamine sesquisulfate monohydrate (CD3) | 5 g |
| Potassium carbonate | 25 g |

pH adjustment to 10.0 with KOH or $H_2SO_4$; water to a total volume of 1 liter

| Bleaching bath | |
|---|---|
| Water | 0.7 l |
| Propylenediamine tetraacetic acid (PDTA) | 10 g |
| Ammonium-iron (III) PDTA | 120 g |
| Ammonium bromide | 80 g |
| Ammonium nitrate | 30 g |
| Acetic acid | 35 g |

Adjustment to pH 4.2 with ammonia water or acetic acid; water to a total volume of 1 liter

| Fixing bath | |
|---|---|
| Water | 0.8 l |
| Sodium sulfite | 20 g |
| Ammonium thiosulfate | 200 g |
| EDTA | 3 g |

Adjustment to pH 7.3 with ammonia water or acetic acid; water to a toal volume of 1 l

| Final bath | |
|---|---|
| Water | 0.9 l |
| Formalin (37% by weight aqueous solution) | 0.5 ml |
| Polyoxyethylene-p-monononylphenyl ether | 0.5 g |

Water to a total volume of 1 l, pH 6.6.

TABLE 1

| Layer combination | Emulsion | Sensitivity |
|---|---|---|
| 1A Comparison | 2 | 19.8 |
| 1B Comparison | 4 | 16.0 |
| 1C Invention | 6 | 26.0 |
| 1D Invention | 8 | 26.9 |
| 1E Invention | 10 | 27.0 |
| 1F Invention | 12 | 27.2 |

TABLE 2

| Layer combination | Inhibition | Edge effect |
|---|---|---|
| 1G Comparison | 0.32 | 0.16 |
| 1H Comparison | 0.24 | 0.10 |
| 1I Invention | 0.44 | 0.32 |
| 1K Invention | 0.40 | 0.30 |
| 1L Invention | 0.49 | 0.38 |
| 1M Invention | 0.41 | 0.30 |

Inhibition is defined as:

$$\frac{\text{gamma 1 (without } DIR \text{ coupler)} - \text{gamma 1 (with } DIR \text{ coupler)}}{\text{gamma 1 (without } DIR \text{ coupler)}}$$

The edge effect is the difference between microdensity and macrodensity at macrodensity 1.0 over fog, as described in James, The Theory of the Photographic Process, 4th Edition, Macmillan Publishing Co., Inc., 1977, page 611.

As can be seen, the emulsions according to the invention are distinguished by higher sensitivity, higher inhibitability and higher edge effects.

EXAMPLE 2

A sample of each of layer combinations 1A to 1F with grey wedges exposed thereon was developed in 1.0 l of the solution described below. Developer solutions A to F were identical at the beginning, but became charged to different extents with halide released in the course of the test. The measured halide contents of developer solutions A to F are shown in Table 4.

| Developer: | |
|---|---|
| Water | 0.9 l |
| EDTA | 2 g |
| HEDP, 60% by weight aqueous solution | 0.5 ml |
| Sodium chloride | 2 g |
| N,N-diethyl hydroxylamine, 85% by weight aqueous solution | 5 ml |
| CD3 | 5 g |
| Potassium carbonate | 25 g |

pH adjustment to 10.0 with KOH or $H_2SO_4$; water to a total volume of 1 l, regeneration 0.50 l/m$^2$ film The samples were then freed from silver in the bleaching and fixing bath mentioned in Example 1, washed and dried. Another 6 m$^2$ of a film of layer combinations 1A to 1F, which had been exposed for 30 seconds to the light of a 60 watt lamp from a distance of 30 cm, were then developed in solutions A to F described above to charge the development bath with halide ions. Finally, another sample with a grey wedge exposed thereon was processed in the same solutions as described above.

The sensitometric parameters of the initial samples and final samples are shown in Table 3.

TABLE 3

| | Initial sample | | | Final sample | | |
|---|---|---|---|---|---|---|
| Sample/developer | S | G1 | Dmax | S | G1 | Dmax |
| 1/A Comparison | 19.8 | 1.54 | 2.93 | 18.9 | 1.04 | 2.41 |
| 1/B Comparison | 16.0 | 1.98 | 3.04 | 16.0 | 1.95 | 3.10 |
| 1/C Invention | 26.0 | 1.75 | 3.04 | 26.0 | 1.79 | 3.11 |
| 1/D Invention | 26.9 | 1.69 | 2.98 | 26.5 | 1.61 | 3.04 |
| 1/E Invention | 27.0 | 1.65 | 3.17 | 26.9 | 1.56 | 3.15 |
| 1/F Invention | 27.2 | 1.68 | 3.09 | 27.1 | 1.52 | 2.98 |

S = Sensitivity
G1 = Gamma 1
Dmax = Maximum density

As can be seen, the samples according to the invention show higher sensitivity for unchanged gamma 1 and unchanged maximum density. The comparison samples show either a reduction in color density (in the case of 1/A) or, generally, excessively low sensitivity (in the case of 1/B).

The bromide and iodide content of developer solutions A to F was determined by ion chromatography at the beginning of the processing of the final samples:

TABLE 4

| Sample | Mmol Bromide/l | Mmol Iodide/l |
|---|---|---|
| 1/A Comparison | 0.59 | <0.005 |
| 1/B Comparison | 0.02 | <0.005 |
| 1/C Invention | 0.01 | <0.005 |
| 1/D Invention | 0.02 | <0.005 |
| 1/E Invention | 0.01 | <0.005 |
| 1/F Invention | 0.02 | <0.005 |

Whereas the emulsion used in layer combination 1A leads to impaired sensitometric results through the release of bromide into the developer and emulsion 4 used in layer combination 1B shows inadequate sensitivity, the Examples according to the invention have high sensitivity without the developer solution becoming charged with bromide and/or iodide.

EXAMPLE 3

Layer combination 2

1st layer (antihalo layer)
0.2 g black colloidal silver
1.2 g gelatine
0.1 g UV absorber UV1
0.02 g TCP
0.03 g dibutyl phthalate (DBP)
2nd layer (low-sensitivity red-sensitized layer)
1.10 g $AgNO_3$ of a red-sensitized emulsion according to Table 5
2.00 g gelatine
0.60 g colorless cyan coupler C1 emulsified in 0.5 g TCP
50 mg colored cyan coupler RM1 and
35 mg colored cyan coupler YM1
30 mg DIR coupler DIR1 emulsified in 20 mg TCP
3rd layer (high-sensitivity red-sensitized layer)
1.04 g $AgNO_3$ of a red-sensitized emulsion according to Table 5
1.80 g gelatine
0.15 g colorless cyan coupler C2 emulsified with 0.15 g DBP
4th layer (separation layer)
0.70 g gelatine
0.20 g 2,5-diisooctyl hydroquinone emulsified with 0.15 g DBP
5th layer (low-sensitivity green-sensitized layer)
0.90 g $AgNO_3$ of a green-sensitized emulsion according to Table 5
1.60 g gelatine
0.60 g magenta coupler M2
50 mg mask coupler YM2 emulsified with 50 mg TCP
30 mg DIR coupler DIR2 emulsified with 20 mg DBP
6th layer (high-sensitivity green-sensitized layer)
1.10 g $AgNO_3$ of a green-sensitized emulsion according to Table 5
1.40 g gelatine
0.15 g magenta coupler M3 emulsified with 0.45 g TCP
30 mg mask coupler as in 5th layer emulsified with 30 mg TCP
7th layer (separation layer)
0.50 g gelatine
0.10 g 2,5-diisooctyl hydroquinone emulsified with 0.08 g DBP
8th layer (yellow filter layer)
0.10 g Ag as yellow colloidal silver sol 0.60 g gelatine
0.40 g formaldehyde scavenger FF-1
0.20 g 2,5-diisooctyl hydroquinone emulsified with 0.16 g DBP
9th layer (low-sensitivity blue-sensitive layer)
0.30 g $AgNO_3$ of a blue-sensitized emulsion according to Table 5
0.85 g gelatine
0.70 g yellow coupler Y1 emulsified with 0.7 g TCP
0.50 g DIR coupler DIR1 emulsified with 0.5 g TCP
10th layer (high-sensitivity blue-sensitive layer)
0.50 g $AgNO_3$ of a blue-sensitized emulsion according to Table 5
0.85 g gelatine
0.30 g yellow coupler Y1 emulsified with 0.3 g TCP
11th layer (protective and hardening layer)
0.30 g gelatine
0.30 g UV absorber UV1
0.40 g hardener corresponding to the formula $(CH_2{=}CH{-}SO_2{-}CH_2{-}CONH{-}CH_2)_2$
0.40 g formaldehyde scavenger FF-1

TABLE 5

| Layer | Emulsion in Sample 2A | Sample 2B | Sample 2C | Sample 2D |
|---|---|---|---|---|
| 2nd, 5th, 9th layer | 1 | 3 | 5 | 11 |
| 3rd, 6th, 10th layer | 2 | 4 | 6 | 12 |

After a step wedge had been exposed onto samples 2A to 2D with white, blue, green and red light, they are processed as follows:

| Processing bath | Time [s] | Temperature [°C.] | Regeneration quota [l/m² film] |
|---|---|---|---|
| Developer | 45 | 38 | 0.50 |
| Bleaching/fixing bath | 150 | 38 | 0.80 |
| Washing | 90 | 38 | 2 (4 × cascade) |
| Final bath | 45 | 38 | 0.50 |

The individual processing baths had the following composition:

| Developer: | |
|---|---|
| Water | 0.9 l |
| EDTA | 2 g |
| HEDP, 60% by weight aqueous solution | 0.5 ml |
| Sodium chloride | 2 g |
| N,N-diethyl hydroxylamine, 85% by weight aqeous solution | 5 ml |
| CD3 | 5 g |
| Potassium carbonate | 25 g |

pH adjustment to 10.0 with KOH or $H_2SO_4$; water to a total volume of 1 liter

| Bleaching/fixing bath | |
|---|---|
| Water | 0.7 l |
| Ammonium-iron (III) EDTA | 90 g |
| EDTA | 5 g |
| 3-Mercapto-1,2,4-triazole | 0.5 g |
| Ammonium thiosulfate | 120 g |
| Sodium disulfite | 10 g |

Adjustment to pH 6.0 with ammonia water or acetic acid; water to a total volume of 1 liter Final bath as in Example 1

After processing, the samples showed the sensitometric data set out in Table 6.

TABLE 6

| Sample | Sensitivity gb/pp/bg | IIE gb/pp/bg |
|---|---|---|
| 2A Comparison | 20.2/19.8/20.1 | 0.09/0.46/0.30 |
| 2B Comparison | 16.2/16.6/16.9 | 0.00/0.02/0.04 |
| 2C Invention | 26.0/26.1/25.8 | 0.10/0.54/0.39 |
| 2D Invention | 27.3/27.2/27.0 | 0.10/0.58/0.47 |

gb: of the yellow-coupling layers, pp: of the magenta-coupling layers, bg: of the cyan-coupling layers The inter-image effect (IIE) is defined as follows:

$$\frac{\text{gamma 1 (colored exposure)} - \text{gamma 1 (white exposure)}}{\text{gamma 1 (white exposure)}}$$

Accordingly, layer combinations 2C and 2D according to the invention show higher sensitivities and higher interimage effects than comparison samples 2A and 2B.

EXAMPLE 4

Samples of layer combinations 2A to 2D with grey wedges exposed thereon were processed in the following development variants:

| Processing bath | Time [s] | Temperature [°C.] | Regeneration quota [l/m² film] |
|---|---|---|---|
| Developer | 30 | 42 | 0.50 |
| Bleaching/fixing bath | 90 | 42 | 0.80 |
| Stabilizing bath | 30 | 42 | 0.80 (3 × cascade) |
| Drying | 30 | 65 | |

The individual processing baths had the following composition:

| Developer (a): | |
|---|---|
| Water | 0.9 l |
| EDTA | 2 g |
| HEDP, 60% by weight aqueous solution | 0.5 ml |
| Sodium chloride | 2 g |
| N,N-diethyl hydroxylamine, 85% by weight aqueous solution | 5 ml |
| 4-(N-ethyl-N-γ-hydroxypropyl)-2-methyl phenylenediamine | 5 g |
| Potassium carbonate | 25 g |

pH adjustment to 10.0 with KOH or $H_2SO_4$; water to a total volume of 1 l

| Developer (b): | |
|---|---|
| Water | 0.9 l |
| EDTA | 2 g |
| HEDP, 60% by weight aqueous solution | 0.5 ml |
| Sodium chloride | 2 g |
| N,N-diethyl hydroxylamine, 85% by weight aqueous solution | 5 ml |
| 4-(N-ethyl-N-d-hydroxybutyl)-2-methyl phenylenediamine | 5 g |
| Potassium carbonate | 25 g |

pH adjustment to 10.0 with KOH or $H_2SO_4$; water to a total volume of 1 liter

Bleaching/fixing bath: as in Example 3

| Stabilizing bath: | |
|---|---|
| Water | 0.9 l |
| Diethylene glycol | 5 g |
| Formalin (37% by weight solution) | 0.5 g |
| Polyoxyethylene-p-monononylphenyl ether | 0.5 g |

Water to a total volume of 1 liter, pH 5.0

TABLE 7

| Sample | Developer | Sensitivity gb/pp/bg | Edge Effect gb/pp/bg |
|---|---|---|---|
| 2A Comparison | (a) | 19.3/19.0/18.5 | 0.18/0.25/0.35 |
| 2B Comparison | (a) | 16.5/16.3/16.0 | 0.01/0.01/0.02 |
| 2C Invention | (a) | 26.2/26.2/25.5 | 0.25/0.30/0.48 |
| 2D Invention | (a) | 27.5/27.0/26.8 | 0.28/0.32/0.50 |
| 2A Comparison | (b) | 19.0/19.3/18.8 | 0.20/0.26/0.38 |
| 2B Comparison | (b) | 16.0/16.3/15.9 | 0.00/0.01/0.03 |
| 2C Invention | (b) | 26.3/26.0/25.8 | 0.27/0.33/0.52 |
| 2D Invention | (b) | 27.0/27.1/26.7 | 0.30/0.33/0.54 |

The advantages of the silver chloride iodide emulsions according to the invention over comparable silver chloride bromide emulsions in the form of higher sensitivity and higher edge effects are also evident in rapid processing.

EXAMPLE 5

Samples of layer combinations 2A to 2D with grey wedges exposed thereon are processed as follows:

| Processing bath | Time [s] | Temperature [°C.] | Regeneration quota [l/m² film] |
|---|---|---|---|
| Developer | 45 | 38 | 0.50 |
| Bleaching bath | 120 | 38 | 0.50 |
| Washing | 45 | 38 | 2 |
| Fixing bath | 120 | 38 | 0.50 |
| Washing | 90 | 38 | 2 (3 × cascade) |
| Stabilizing bath | 30 | 38 | 0.50 |

The individual processing baths had the following composition:

| Developer: | |
|---|---|
| Water | 0.9 l |
| EDTA | 2 g |
| HEDP, 60% by weight aqueous solution | 0.5 ml |
| Sodium chloride | 2 g |
| N,N-diethyl hydroxylamine, 85% by weight aqueous solution | 5 ml |
| 4-(N-ethyl-N-d-hydroxybutyl)-2-methyl phenylenediamine | 5 g |
| Potassium carbonate | 25 g |

pH adjustment to 10.0 with KOH or $H_2SO_4$; water to a total volume of 1 liter

| Bleaching bath | |
|---|---|
| Water | 0.7 l |
| Iron salt of nitrilodiacetomono- | 90 g |

-continued

| Bleaching bath | |
|---|---|
| propionic acid | |
| Nitrilodiacetomonopropionic acid | 10 g |
| Sodium bromide | 70 g |
| Sodium nitrate | 20 g |
| Acetic acid | 18 g |

pH adjustment to 4.4 with ammonia water or acetic acid; water to a total volume of 1 liter

| Fixing bath | |
|---|---|
| Water | 0.8 l |
| Sodium thiosulfate | 120 g |
| EDTA | 3 g |
| Sodium bisulfite | 13 g |
| Sodium hydroxide | 2.5 g |

Adjustment to pH 7.3 with sodium hydroxide or acetic acid; water to a total volume of 1 liter Final bath: as Example 1

The advantages of the materials according to the invention become particularly clear where ecologically favorable bleaching and fixing baths are used (Table 8). The layer combinations according to the invention show better sensitivity than comparison samples 2A and 2B without any unbleached or unfixed residual silver being present.

TABLE 8

| Layer combination | Sensitivity gb/pp/bg | Residual silver g Ag/m² |
|---|---|---|
| 2A Comparison | 20.0/19.6/19.9 | 0.05 |
| 2B Comparison | 16.0/16.3/16.0 | 0.04 |
| 2C Invention | 25.8/25.9/25.6 | 0.05 |
| 2D Invention | 27.1/27.0/26.8 | 0.04 |

EXAMPLE 6

Layer combinations 2A', 2C' and 2D' correspond to combinations 2A, 2C and 2D, differing only in the presence of an additional layer 10a between the 10th and 11th layers:

Layer 10a: (protective layer)

0.40 g $AgNO_3$ of emulsion 4 (spectrally non-sensitized)
0.45 g gelatine

The deactivation of the color developer by processing of layer combinations 2A, 2C and 2D and 2A', 2C' and 2D' was determined in the same way as in Example 2 by a sensitometric test before and after the passage of 6 m² of these layer combinations through 1 liter of the color developer solution mentioned therein.

The results set out in Table 9 show that the deactivation of the developer solution by processing of layer combinations 2C' and 2D' containing the AgCl protective layer is even lower than deactivation by processing of layer combinations 2C and 2D. In all four combinations according to the invention (2C, 2D, 2C' and 2D'), however, it is distinctly lower than in the two comparison combinations 2A and 2A'.

TABLE 9

| Layer combination | Initial sample Sensitivity gb/pp/bg | Gradation gb/pp/bg | Final sample Sensitivity gb/pp/bg | Gradation gb/pp/bg |
|---|---|---|---|---|
| 2A | 20.2/19.8/20.1 | 0.74/0.68/0.61 | 19.2/19.0/19.1 | 0.70/0.59/0.28 |

TABLE 9-continued
| Layer combination | Initial sample Sensitivity gb/pp/bg | Gradation gb/pp/bg | Final sample Sensitivity gb/pp/bg | Gradation gb/pp/bg |
|---|---|---|---|---|
| 2C | 26.0/26.1/25.8 | 0.76/0.65/0.62 | 26.0/26.0/25.2 | 0.74/0.63/0.59 |
| 2D | 27.3/27.2/27.0 | 0.76/0.66/0.62 | 27.1/27.2/27.0 | 0.73/0.63/0.58 |
| 2A' | 20.8/20.5/20.5 | 0.75/0.68/0.61 | 20.0/19.8/19.5 | 0.73/0.62/0.38 |
| 2C' | 27.0/26.9/26.0 | 0.76/0.66/0.62 | 27.0/27.0/26.1 | 0.75/0.66/0.62 |
| 2D' | 27.9/27.7/27.0 | 0.77/0.66/0.62 | 27.9/27.8/27.2 | 0.77/0.67/0.61 |
Formulae of the substances used:
UV-1
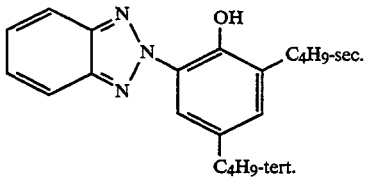
FF-1
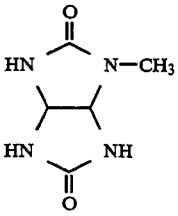
C1:
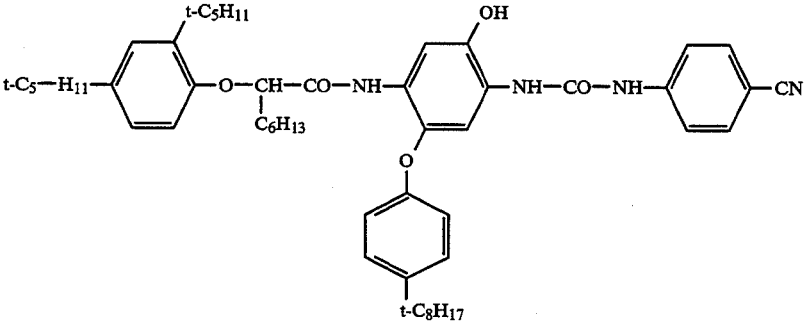
C2:
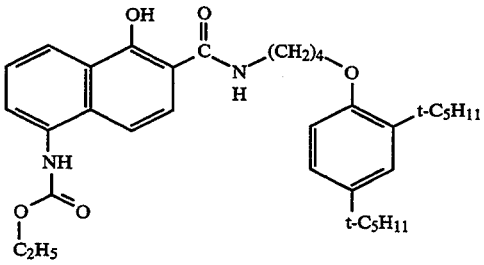
M1
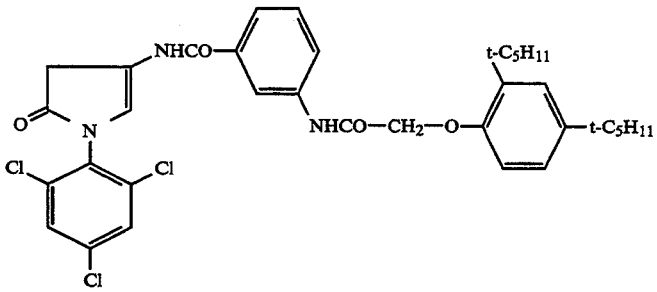

-continued
Formulae of the substances used:
M2
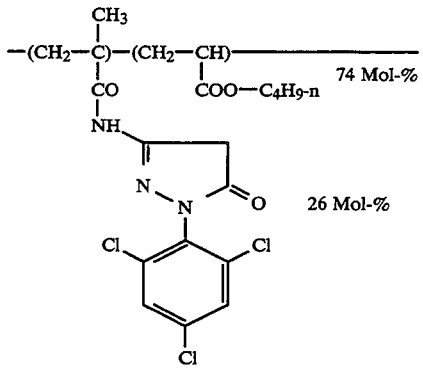
M3
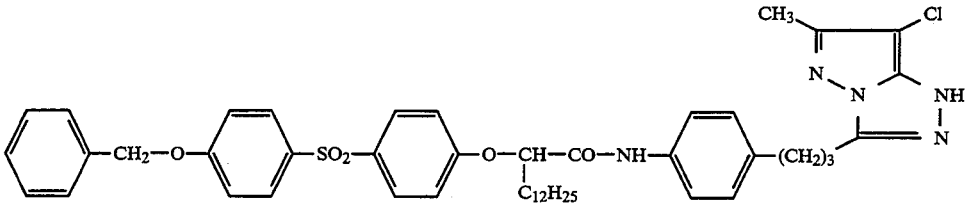
Y1
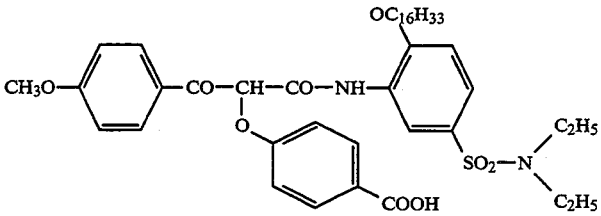
YM2
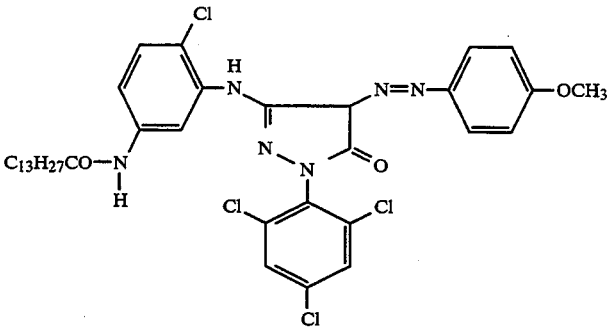
DIR1
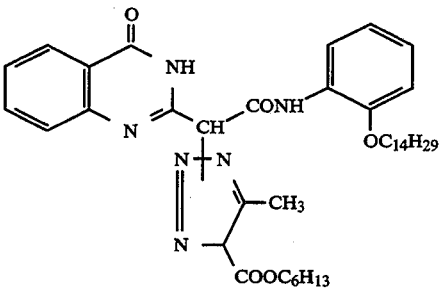

-continued

Formulae of the substances used:

DIR2

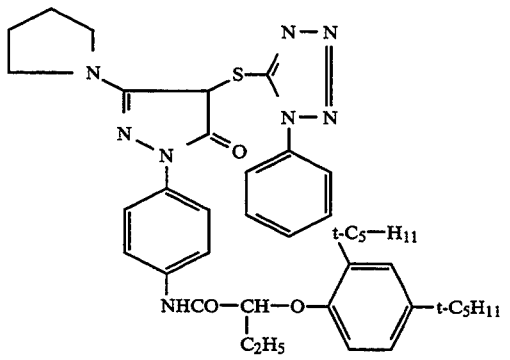

RM1

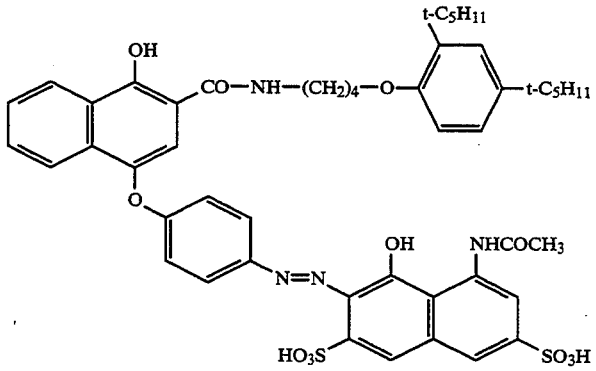

YM1

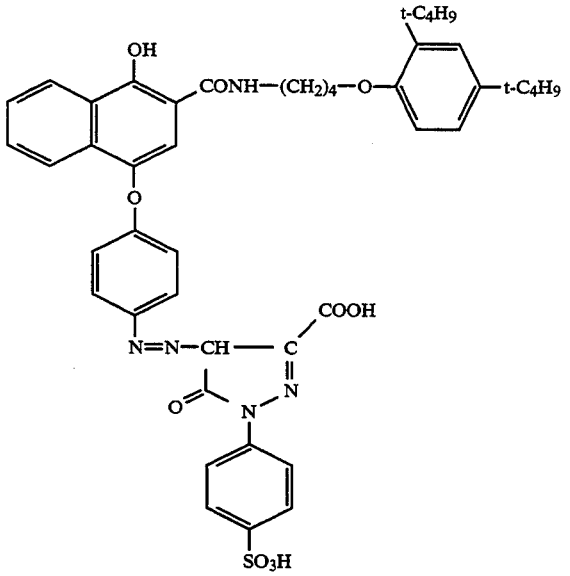

We claim:

1. A color photographic silver halide material comprising on a support the following photosensitive silver halide emulsion layers:

at least one red-sensitive, cyan-coupling silver halide emulsion layer, at least one green-sensitive, magenta-coupling silver halide emulsion layer and at least one blue-sensitive, yellow-coupling silver halide emulsion layer, the silver halide emulsion of at least one of said photosensitive silver halide emulsion layers comprising 85 to 99 mol-% AgCl, 1 to 10 mol-T AgI and 0 to 5 mol-% AgBr, wherein the photographic silver halide material contains a layer which is arranged further from the support than each photosensitive layer and said layer contains a silver halide with at least 98 mol-% AgCl which is non-sensitive in the visible spectral region.

2. A camera-sensitive color photographic silver halide material comprising, on a transparent support:

at least one red-sensitive, cyan-coupling silver halide emulsion layer, at least one green-sensitive, magenta-coupling silver halide emulsion layer, and at least one blue-sensitive, yellow-coupling silver halide emulsion layer, wherein the silver halide emulsion of at least one photo-sensitive silver halide emulsion layer consists essentially of 85 to 99 mol-% AgCl, 1 to 10 mol-% AgI and 0 to 5-mol % AgBr, and said material additionally contains a layer which is arranged further from the support than each photo-sensitive layer and contains a silver halide with at least 98 mol-% AgCl which is non-sensitive in the visible spectral region.

* * * * *